United States Patent [19]

Nightingale

[11] Patent Number: 4,457,100

[45] Date of Patent: Jul. 3, 1984

[54] FIGURE KICKING TOY

[76] Inventor: Christopher C. Nightingale, 5220 NE. 29th Ave., Fort Lauderdale, Fla. 33308

[21] Appl. No.: 423,713

[22] Filed: Sep. 27, 1982

[51] Int. Cl.[3] ..... A63H 33/26

[52] U.S. Cl. ..... 446/333; 446/358; 446/116; 446/163

[58] Field of Search ..... 46/248, 265, 264, 228, 46/227, 226, 128, 116, 119, 163, 164; 40/411, 418, 414

[56] References Cited

U.S. PATENT DOCUMENTS

| | | | |
|---|---|---|---|
| 155,827 | 10/1874 | Clay | 46/116 |
| 1,018,311 | 2/1912 | Gaines . | |
| 1,216,632 | 2/1917 | Walker et al. . | |
| 1,322,199 | 11/1919 | Murphy . | |
| 2,448,951 | 9/1948 | Baum | 46/4 |
| 2,506,260 | 5/1950 | Yaggy | 46/42 |
| 3,298,120 | 1/1967 | Walden | 46/264 X |
| 3,599,364 | 8/1971 | Garcia | 46/266 X |

*Primary Examiner*—Mickey Yu
*Attorney, Agent, or Firm*—Oltman and Flynn

[57] ABSTRACT

This toy has a kicking foot driven through a mechanical linkage from a battery-powered motor under the control of a manual switch. A toy figure in front of the kicking foot has an articulated leg which is part of a mechanical linkage coupling it to the motor. This articulated leg operates a linkage rod inside the torso of the toy figure to move the figure's arms, turn its head, and cause its jaw to drop open when a kick is delivered. A lamp near the figure's posterior is turned on when the kick is delivered.

12 Claims, 8 Drawing Figures

FIGURE KICKING TOY

SUMMARY OF THE INVENTION

This invention relates to a toy or amusement device having a kicking foot which is selectively operable to kick a toy figure which responds to the kick.

In the presently preferred embodiment of this invention, the toy figure has an articulated leg which is part of a mechanical linkage operated by a battery-powered motor. This leg operates a linkage rod inside the torso of the toy figure for causing the figure's head to turn and its jaw to drop open when kicked, as well as causing one of the figure's hands to move toward the figure's posterior. A lamp near the posterior comes on when the kick is received. The kicking foot is operated by a battery-powered motor under the control of a manually operated switch. The lamp is energized from the same battery as the motor through the manually operated switch and a control switch operated by the articulated leg of the toy figure.

A principal object of this invention is to provide a novel toy having a toy figure which responds in a novel way when kicked.

Another object of this invention is to provide such a toy which the user may operate selectively to apply a kick to the toy figure.

Another object of this invention is to provide a figure kicking toy in which the reaction of the toy figure to being kicked is affected through a mechanical linkage driven by the same motive power source as the kicking foot and operated in timed relation with the kicking foot.

Further objects and advantages of this invention will be apparent from the following detailed description of a presently-preferred embodiment which is illustrated schematically in the accompanying drawings.

Before explaining the disclosed embodiment of the present invention in detail, it is to be understood that the invention is not limited in its application to the detail of the particular arrangement shown, since the invention is capable of other embodiments. Also, the terminology used herein is for the purpose of description and not of limitation.

DETAILED DESCRIPTION

Figure 3:
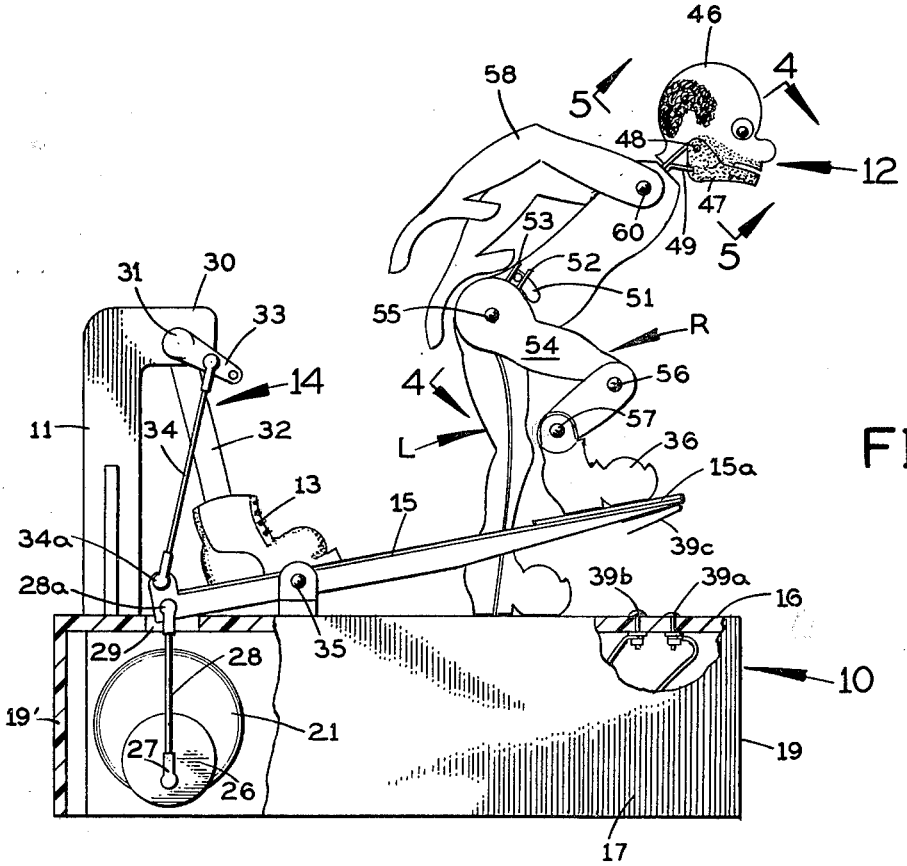
FIG. 3 is a side elevation showing the opposite side of the toy from the one shown in FIG. 1 with the kicking foot retracted and parts of the base broken open to reveal working parts.

Referring first to FIG. 3, in broad outline the present invention comprises a base 10, a standard 11 extending up from the base, the figure 12 of a person standing in front of the standard with his left foot fixed to the base and his right leg movable up and down, and a kicking shoe 13 horizontally pivoted on the standard 11 for movement between a lowered position (FIG. 3) in which it is retracted away from the figure 12 and a raised position (FIG. 1) in which it applies a kick to the posterior of the figure 12. The kicking shoe 13 is operated by a motor-driven linkage 14 which also operates a pivoted platform 15 for raising and lowering the right foot of figure 12. The right leg of figure 12 is part of a linkage in the figure 12 for moving its arms and causing the figure's lower jaw to seem to drop open when a kick is applied.

Figure 2:
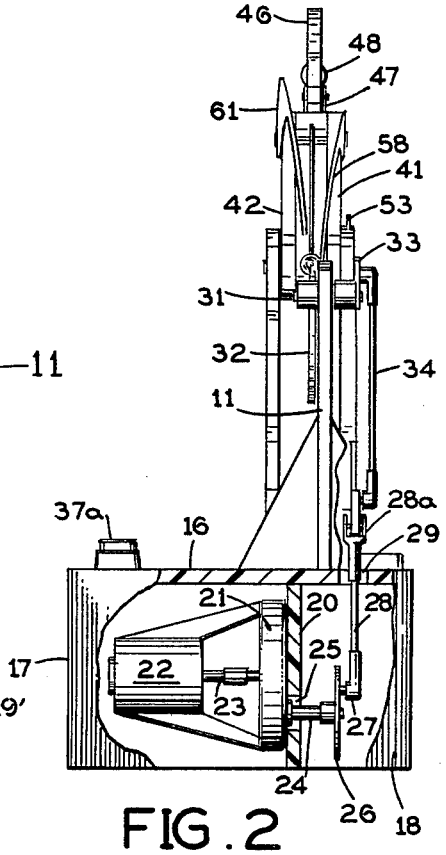
FIG. 2 is an end elevation taken from the right end of FIG. 1 with the base of the toy broken open to reveal working parts.

As shown in FIGS. 2 and 3, the base 10 is of hollow rectangular construction, presenting a horizontal top wall 16, opposite sides 17 and 18 extending down from the top wall, and opposite ends 19 and 19' extending down from the top wall between the sides. The base has a vertical interior wall 20 (FIG. 2) to which is attached a gear reduction 21 driven by a small electric motor 22. The motor shaft 23 is coupled to the inut of the gear reduction. The output of the gear reduction is connected to a horizontal shaft 24 which extends through an opening 25 in the interior wall 20 of the base. Shaft 24 carries a crank plate 26 to which a crank 27 is coupled at an off-center location. The crank 27 is on the lower end of a linkage arm 28 which extends up through an opening 29 in the top wall 16 of base 10.

The standard 11 is of inverted L shape and has its lower end affixed to the top wall 16 of the base immediately to the left of the opening 29 in FIG. 3. At its upper end the standard presents a short horizontal leg 30 spaced vertically above opening 29. This upper leg of standard 11 rotatably supports a horizontal pivot shaft 31 (FIG. 1) for the upper end of a rigid arm 32 carrying the kicking shoe 13 on its lower end. On the opposite side of the standard the pivot shaft 31 carries a linkage arm 33 (FIG. 3) which is pivotally coupled to the upper end of a linkage arm 34. The lower end of linkage arm 34 and the upper end of the motor driven linkage arm 28 in base 20 are separately coupled pivotally to the platform 15 at **34*a* and 28*a* in FIG. 3. Platform 15 is horizontally pivoted at 35 between the linkage arms 28 and 34 on one side and the figure 12** on the opposite side.

When the linkage rod 28 is in its lowermost position (FIG. 3), through the linkage provided by a platform 15, linkage rod 34 and linkage arm 33 it holds shaft 31 in its extreme clockwise position in FIG. 3, thereby positioning the kicking shoe 13 in its retracted, lowered position away from the posterior of the figure 12. Also, it holds platform 15 counterclockwise in FIG. 3 so that the opposite end **15*a* of the platform keeps the right foot 36 of the figure 12** raised.

Figure 7:
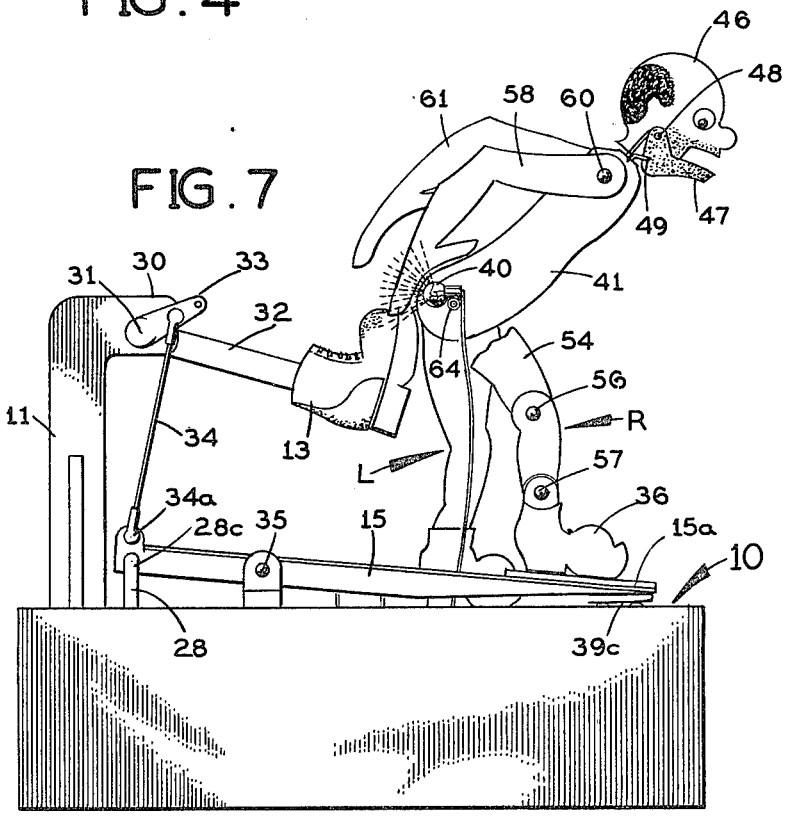
FIG. 7 is a side elevation of the opposite side of the toy from FIG. 1 with the operating parts in the same position.

When the linkage rod 28 moves up in response to energization of its drive motor 22, it rocks platform 15 clockwise in FIG. 3 to the position shown in FIG. 7. This causes the shoe-carrying arm 32 to pivot counterclockwise in FIG. 3 to the position shown in FIG. 7, where the kicking shoe 13 almost engges the posterior of the figure 12. Also, the free end **15*a* of platform 15 lowers the figure's right foot 36** to the FIG. 7 position.

Figure 8:
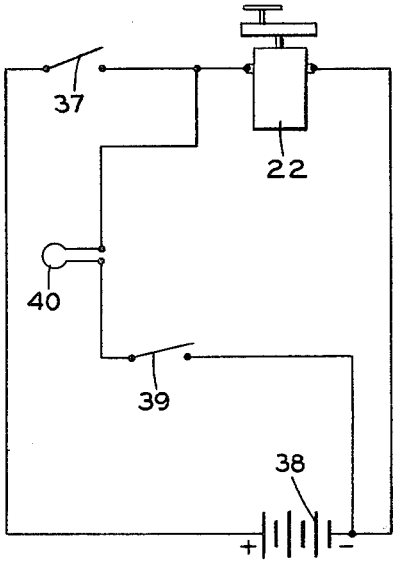
FIG. 8 is a schematic diagram of the electrical circuit for the motor and lamp in the toy.

Referring to FIG. 8, the motor 22 is turned on and off by a normally-open, manually operable switch 37 connected in series with the motor across a battery 38. The on-off switch 37 is under the control of a push button 37*a* (FIG. 1) which projects up above the top wall 16 of the base. When this push button is depressed it closes switch 37, enabling motor 22 to be energized from battery 38.

The circuit of FIG. 8 also includes a normally-open switch 39 connected in series with a lamp 40 across the motor 22 so that, with the on-off switch 37 closed, lamp 40 will be turned on when switch 39 is closed. Referring to FIG. 3, switch 39 has fixed contacts 39*a* and 39*b* which are exposed at the top wall 16 of base 10 and a movable bridging contact 39*c* on the bottom of the free end 15*a* of platform 15. When this end of the platform is up, as shown in FIG. 3, switch 39 is open. When this end of the platform comes down, the bridging contact 39*c* engages both fixed contacts 39*a* and 39*b*, closing switch 39 to turn on lamp 40. As shown in FIG. 7, lamp 40 is positioned in close proximity to the posterior of figure 12, so that when the user sees the kicking shoe 13 kick the figure, he or she will also see lamp 40 turn on.

Figure 4:
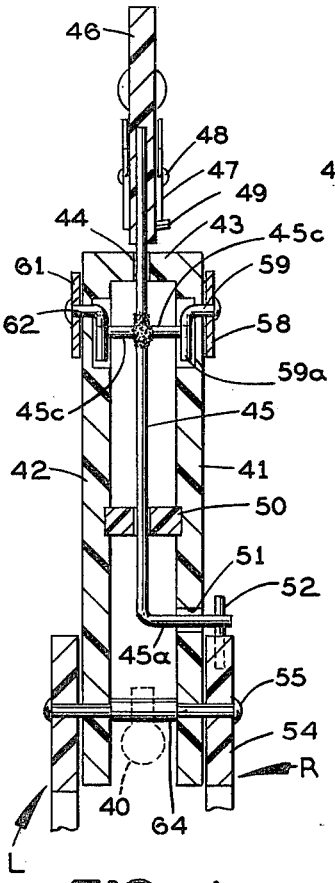
FIG. 4 is a cross-section through the torso of the man's figure taken along the line 4—4 in FIG. 3.

As shown in FIG. 4, the torso of the figure 12 is defined by closely spaced parallel, flat, thin sides 41 and 42 joined at their upper ends by a transverse top wall 43. This top wall is formed with an opening 44 which slidably passes the upper end of an L-shaped linkage rod 45. The head of figure 12 except the lower jaw is fastened to the upper end of rod 45 above the top wall 43 of the torso. The rear end of the lower jaw 47 (FIG. 6) is horizontally pivoted at 48 on the head 46.

Figure 1:
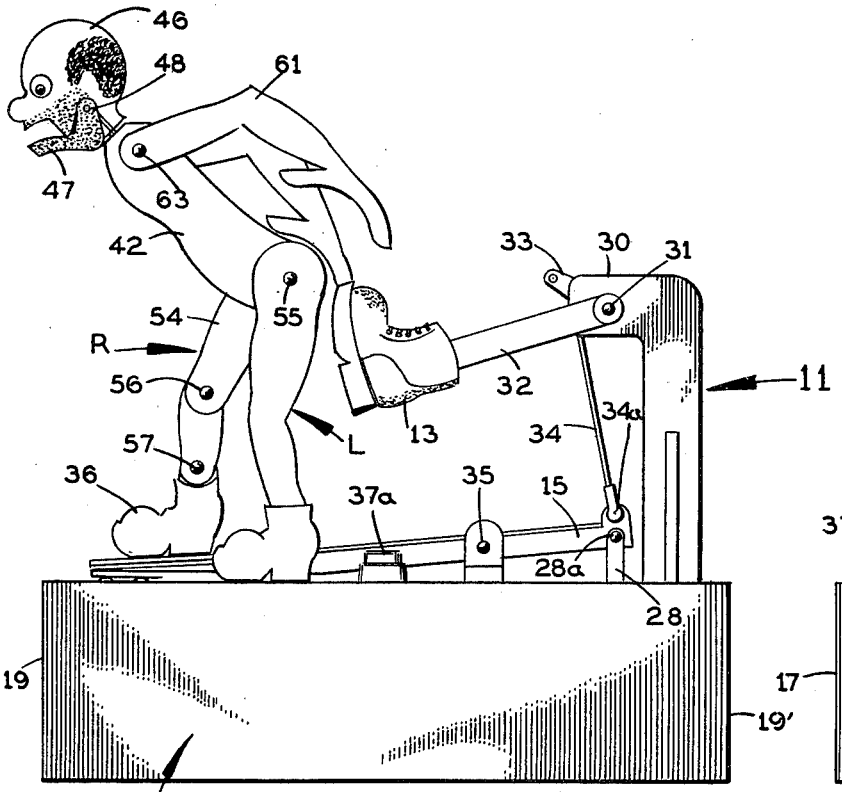
FIG. 1 is a side elevational view of the present kicking toy showing the figure of a man being kicked.
Figure 5:
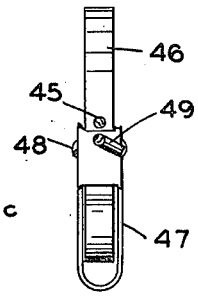
FIG. 5 is a cross-section taken along the line 5—5 in FIG. 3 just below the head of the figure.
Figure 6:
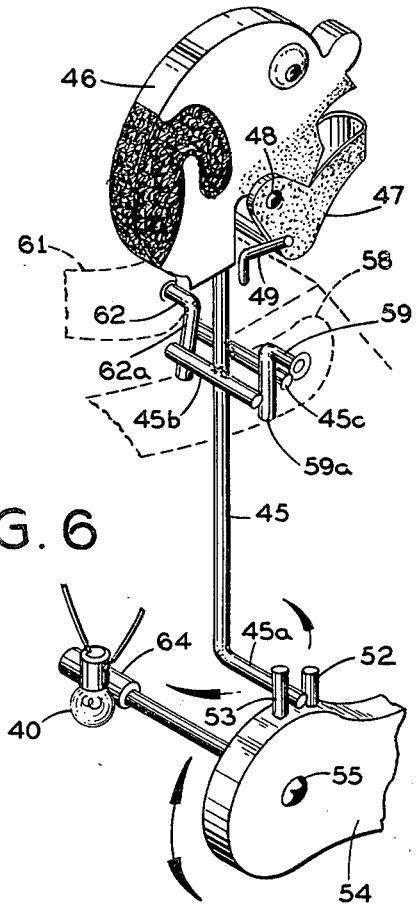
FIG. 6 is a schematic perspective view showing operating parts for moving the head and arms of the man's figure.

A stop pin 49 engages the jaw 47 from behind. This pin has a downwardly bent lower end which is anchored in the top wall 43 of the figure's torso. The upper end of pin 49 is inclined upward and rearward to the right, as shown in FIGS. 5 and 6. As explained hereinafter, depending upon the rotational position of head 46, the stop pin 49 either holds the lower jaw 47 up in a mouth-closing position (FIG. 3) or permits it to drop to a mouth-opening position (FIGS. 1, 6 and 7).

As shown in FIG. 4, inside the torso of the figure 12 the linkage rod 45 extends down rotatably through a fixed guide bushing 50 and terminates in a horizontal bottom segment 45*a* which extends out through an arcuate opening 51 in the side 41 of the torso. As shown in FIG. 6, segment 45*a* is engaged between two pins 52 and 53 projecting up from the figure's right thigh 54. As shown in FIG. 3, the figure 12 has a horizontal pivot 55 at the hip between thigh 54 and the lower end of the figure's torso, another horizotal pivot 56 at the knee, and still another horizontal pivot 57 as close as practical to where the ankle would be. This lower pivot 57 is immediately above the right foot 36. This foot and the articulated right leg and thigh form a mechanical linkage between the free end 15*a* of platform 15 and the L-shaped linkage rod 45 which carries the figure's head 46.

When the right leg of figure 12 is raised (FIG. 3) the pin 52 on its thigh 54 bears against the lower end 45*a* of linkage rod 45 and rotates rod 45 to the right in FIG. 6. Head 46 turns to the right and the jaw 47 closes. Conversely, when the right leg is lowered (FIG. 7) the other pin 53 on its thigh bears against the lower end 45*a* of linkage rod 45 and rotates rod 45 to the left. Head 46 turns to the left and the jaw 47 drops open.

As shown in FIG. 6, at the level of the shoulders of the figure 12 the linkage arm 45 carries opposite cross pins 45*b* and 45*c*, each of which projects horizontally on opposite sides of the linkage arm. The right arm 58 of the figure 12 has a right-angled pin 59 (FIG. 6) which is horizontally pivoted in the right side 41 of the torso of the figure 12 at the shoulder axis 60 in FIG. 3. Pin 59 has a downwardly extending segment 59*a* (FIG. 6) which is snugly received between the linkage arm cross pins 45*b* and 45*c*. Similarly, the left arm 61 of figure 12 has a right-angled pin 62 (FIG. 6) which is horizontally pivoted in the left side 42 of the torso at the shoulder axis 63 in FIG. 1. Pin 62 has a downwardly extending segment 62*a* (FIG. 6) which is snugly received between the linkage arm cross pins 45*b* and 45*c*.

With this linkage arrangement, when the figure's right leg is in its raised position (FIG. 3), the right arm 58 is raised to move the right hand away from the figure's posterior while the left arm 61 is lowered to position the left hand in close proximity to the figure's posterior. Conversely, when the figure's right leg is in its lowered position (i.e., when the figure is being kicked, as shown in FIGS. 1 and 7) the right arm 58 is lowered to position the right hand substantially against the figure's posterior and the left arm 61 is raised to position the left hand away from the posterior.

As shown in FIGS. 4 and 6, pivot axis 55 for the thigh joint 54 of the figure's right leg is defined by a cross pin which extends horizontally through the opposite sides 41 and 42 of the figure's upper torso. A cylindrical bushing 64 (FIG. 4) engaged between these sides of the upper torso rotatably supports this cross pin and defines an abutment against which the lamp 40 rests, as shown in FIG. 6.

OPERATION

When the eccentric plate 26 positions linkage arm 28 in the down position (FIG. 3), the kicking shoe 13 is in its lowered, retracted position, the free end 15*a* of the platform 15 is up, the right leg R of figure 12 is raised, the figure's head 46 is turned to the right and its mouth is closed, the figure's left hand is next to its posterior and its right hand is raised away from the posterior, switch 39 is open, and lamp 40 is off.

When the eccentric plate 26 moves the linkage arm 28 up to the position shown in FIGS. 1 and 7, the kicking shoe 13 is moved up to simulate a kick against the posterior of the figure 12 in front, and at the same time the free end 15*a* of platform 15 is lowered to close switch 39 and turn on lamp 40, as well as turning the figure's head 46 to the left, opening the mouth, the figure's left hand moves back up to a retracted position away from the figure's posterior and the right hand moves down against the posterior.

From the foregoing it will be apparent that whenever the user is so inclined, such as when the user or someone else has made a mistake of some kind, simply by operating the push button 37*a* a kick can be delivered to the koy figure, causing it to react in several different ways, as described, to relieve whatever feelings of chagrin or hostility the user might have.

I claim:

1. In a figure kicking toy having:

a movable kicking foot operatively arranged to be extended and retracted;

a toy figure positioned to be kicked by said kicking foot when the latter is extended, said toy figure having movable visible external means thereon;

and means for extending and retracting said kicking foot including a motive power source and a linkage acting between said motive power source and said kicking foot;

the improvement which comprises:

mechanical linkage means acting between said motive power source and said movable visible external means of the toy figure to move the same in timed relation with the extension of said kicking foot;

said movable visible external means of the toy figure comrising a head of the figure mounted to be turned to the right or left and having a pivoted lower jaw;

said mechanical linkage means comprising a rotatable rod carrying said head and means for rotating said rod in timed relation with the movement of said kicking foot;

and further comprising:

a stop member mounted on the torso of the figure and operatively engaging said jaw to hold the jaw closed when the head is turned in one direction and to permit the jaw to drop open when the head is turned in the opposite direction.

2. A toy according to claim 1, wherein:

said movable visible external means of the toy figure also comprises pivoted right and left arms of the figure with respective hands which are movable toward and away from the posterior of the figure;

and said rotatable rod is operatively coupled to said arms to move the respective hands in opposite directions upon rotation of said rod in either direction of its rotation.

3. A toy according to claim 2, wherein said motive power source is a battery-powered motor.

4. A toy according to claim 3, and further comprising:

a battery-powered lamp positioned adjacent the posterior of the toy figure;

and a switch in series with said lamp and controlling its energization, said switch being operatively coupled to said mechanical linkage means to be closed in one position of said linkage means and opened in another position of said linkage means.

5. In a figure kicking toy having:

a movable kicking foot operatively arranged to be extended and retracted;

a toy figure positioned to be kicked by said kicking foot when the latter is extended, said toy figure having movable visible external means thereon;

and means for extending and retracting said kicking foot including a battery powered motor and a linkage acting between said motor and said kicking foot;

the improvement which comprises:

mechanical linkage means acting between said motor and said movable visible external means of the toy figure to move the same in timed relation with the extension of said kicking foot;

a battery-powered lamp positioned adjacent the posterior of the toy figure;

and a switch in series with said lamp and cntrolling its energization, said switch being operatively coupled to said mechanical linkage means to be closed in one position of said linkage means and opened in another position of said linkage means.

6. In a figure kicking toy having:

a movable kicking foot operatively arranged to be extended and retracted;

a toy figure positioned to be kicked by said kicking foot when the latter is extended, said toy figure having movable visible external means thereon;

means for extending and retracting said kicking foot including a motive power source and a linkage acting between said motive power source and said kicking foot;

and mechanical linkage means acting between said motive power source and said movable visible external means of the toy figure to move the same in timed relation with the extension of said kicking foot;

said toy figure having an articulated leg which is movable up and down and forms part of said mechanical linkage means acting between said motive power source and said movable visible external means of the toy figure;

said mechanical linkage means including a platform operatively coupled between said motive power source and said leg for moving said leg up and down;

said movable visible external means of the toy figure being a hand of the figure movable toward and away from the posterior of the figure.

7. In a figure kicking toy having:

a movable kicking foot operatively arranged to be extended and retracted;

a toy figure positioned to be kicked by said kicking foot when the latter is extended, said toy figure having movable visible external means thereon;

means for extending and retracting said kicking foot including a motivve power source and a linkage acting between said motive power source and said kicking foot;

and mechanical linkage means acting between said motive power source and said movable visible external means of the toy figure to move the same in timed relation with the extension of said kicking foot;

said toy figure having an articuated leg which is movable up and down and forms part of said mechanical linkage means acting between said motive power source and said movable visible external means of the toy figure;

said mechanical linkage means including a platform operatively coupled between said motive power source and said leg for moving said leg up and down;

said movable visible external means of the toy figure comprising pivoted right and left arms of the figure with respective hands which are movable toward and away from the posterior of the figure;

and said leg of the toy figure being operatively coupled to said arms to move the respective hands in opposite directions.

8. In a figure kicking toy having:

a movable kicking foot operatively arranged to be extended and retracted;

a toy figure positioned to be kicked by said kicking foot when the latter is extended, said toy figure having movable visible external means thereon;

means for extending and retracting said kicking foot including a motive power source and a linkage acting between said motive power source and said kicking foot;

and mechanical linkage means acting between said motive power source and said movable visible external means of the toy figure to move the same in timed relation with the extension of said kicking foot;

said toy figure having an articuated leg which is movable up and down and forms part of said mechanical linkage means acting between said motive power source and said movable visible external means of the toy figure;

said mechanical linkage means including a platform operatively coupled between said motive power source and said leg for moving said leg up and down;

said movable visible external means of the toy figure comprising a head of the figure having a pivoted lower jaw.

9. In a figure kicking toy having:

a movable kicking foot operatively arranged to be extended and retracted;

a toy figure positioned to be kicked by said kicking foot when the latter is extended, said toy figure having movable visible external means thereon;

means for extending and retacting said kicking foot including a motive power source and a linkage acting between said motive power source and said kicking foot;

mechanical linkage means acting between said motive power source and said movvable visible external means of the toy figure to move the same in timed relation with the extension of said kicking foot;

said toy figure having an articuated leg which is movable up and down and forms part of said mechanical linkage means acting between said motive power source and said movable visible external means of the toy figure;

said mechanical linkage means including a platform operatively coupled between said motive power source and said leg for moving said leg up and down;

said movable visible external means of the toy figure comprising a head of the figure mounted to be turned to the right or left and having a pivoted lower jaw;

and said mechanical linkage means comprising a rotatable rod carrying said head and operatively coupled to said leg of the toy figure to be rotated in timed relation with the movement of said kicking foot;

and a stop member mounted on the torso of the figure and oeratively engaging said jaw to hold the jaw closed when the head is turned in one direction and to permit the jaw to drop open when the head is turned in the opposite direction.

10. A toy according to claim 9, wherein:

said movable visible external means of the toy figure also comprises pivoted right and left arms of the figure with respective hands which are movable toward and away from the posterior of the figure;

and said rotatable rod is operatively coupled to said arms to move the respective hands in opposite directions upon rotation of said rod in either direction of its rotation.

11. A toy according to claim 10, wherein:

said motive power source is a battery-powered motor;

and further comprising:

a battery-powered lamp positioned adjacent the posterior of the toy figure;

and a switch in series with said lamp and controlling its energization, said switch being operatively coupled to said mechanical linkage means to be closed in one position of said linkage means and opened in another position of said linkage means.

12. In a figure kicking toy having:

a movable kicking foot operatively arranged to be extended and retracted;

and a toy figure positioned to be kicked by said kicking foot when the latter is extended;

the improvement which comprises:

an electric motor operatively coupled to said kicking foot for moving it between said retracted and extended positions;

a lamp positioned adjacent the posterior of the toy figure;

a manual switch controlling the energization of both said motor and said lamp;

and a control switch operatively arranged to turn on said lamp when said kicking foot moves to its extended position.

* * * * *